US006648529B2

(12) United States Patent
Bartolome et al.

(10) Patent No.: US 6,648,529 B2
(45) Date of Patent: Nov. 18, 2003

(54) HARDCOPY APPARATUS CARRIAGE BEAM

(75) Inventors: Jordi Bartolome, Barcelona (ES); Joaquim Brugue, Barcelona (ES); Celia Sanz, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 95 days.

(21) Appl. No.: 09/932,985

(22) Filed: Aug. 21, 2001

(65) Prior Publication Data

US 2002/0025210 A1 Feb. 28, 2002

(30) Foreign Application Priority Data

Aug. 24, 2000 (EP) ..... 00118444

(51) Int. Cl.[7] ..... B41J 11/22
(52) U.S. Cl. ..... 400/354; 400/352
(58) Field of Search ..... 400/283, 352, 400/354, 693, 691, 694

(56) References Cited

U.S. PATENT DOCUMENTS

| | | | | | |
|---|---|---|---|---|---|
| 4,701,593 | A | * | 10/1987 | Hiramatsu | 347/200 |
| 5,195,836 | A | * | 3/1993 | Longust et al. | 400/354 |
| 5,708,907 | A | * | 1/1998 | Masuda et al. | 399/1 |
| 5,815,171 | A | * | 9/1998 | Brugue | 347/8 |
| 5,838,345 | A | * | 11/1998 | Kerr et al. | 347/37 |
| 6,034,713 | A | * | 3/2000 | Kerr et al. | 347/257 |
| 6,364,555 | B1 | * | 4/2002 | Kerr | 400/691 |
| 6,379,064 | B1 | * | 4/2002 | Giles et al. | 400/691 |
| 6,394,568 | B1 | * | 5/2002 | Menendez | 347/8 |

FOREIGN PATENT DOCUMENTS

| | | | |
|---|---|---|---|
| DE | 3634819 | 4/1988 | B41J/29/02 |
| EP | 0540265 | 3/1996 | B41J/29/02 |
| EP | 0814595 | 12/1997 | H04N/1/06 |
| EP | 1029697 | 8/2000 | B41J/29/02 |

OTHER PUBLICATIONS

Search Report for Corresponding European Patent Application No. 00118444.9.

* cited by examiner

*Primary Examiner*—Daniel J. Colilla

(57) ABSTRACT

A carriage slider rod is mounted on a steel beam by means of brass support elements. The support elements are first riveted to the beam and then have precisely aligned V-shape grooves machined therein to provide accurate location for the slider rod. The slider rod is screwed to the beam using central bores passing through the support elements. To fix the support elements to the beam, they are first located in respective apertures and then deformed by a clenching tool, one jaw of which passes through an adjacent aperture in the bottom wall of the beam.

21 Claims, 2 Drawing Sheets

HARDCOPY APPARATUS CARRIAGE BEAM

FIELD OF THE INVENTION

The present invention relates to a printer beam and more particularly to a structural beam for supporting a slider rod upon which slides a printhead carriage.

BACKGROUND OF THE INVENTION

It is a well-known need in printers to be able to keep constant the distance between the printhead and the print medium, the so-called "pen to paper" spacing. If this distance varies, the dots are not printed accurately and the print quality deteriorates. To achieve this object, it is essential to keep the slider rod or rods as straight as possible.

One previous proposal to solve this problem is to use a beam of extruded aluminium and to accurately machine V-shaped grooves along its length to support two slider rods. Such a beam is disclosed in co-pending European patent application 99301172.5. However, such beams are relatively expensive to manufacture, and the machining operation is time-consuming. The slider rods are usually made of steel and so problems can also arise with respect to differential thermal expansion.

Another previous proposal, for example as disclosed in U.S. Pat. No. 5,195,836, is to mount the slider rods on the beam by means of a plurality of individually adjustable bridges. Again such methods of assembly are expensive and time consuming.

The present invention seeks to overcome or reduce one or more of the above problems.

SUMMARY OF THE INVENTION

According to a first aspect of the present invention, there is provided a method of manufacturing a hardcopy apparatus support comprising the steps of fixing a plurality of support elements at spaced intervals in a substantially straight line on a beam member, machining precisely aligned faces in portions of the support elements spaced from the beam member, and mounting and securing a slider rod to said faces.

Each support element may have a generally V-shaped groove precisely machined therein. In a modification, each support element has a single precisely machined face.

According to a second aspect of the present invention, there is provided a support member for a hardcopy apparatus carriage comprising a beam member, at least one slider rod and means for securing the rod to the beam member, characterised in that said securing means comprises a plurality of support elements fixed at spaced intervals in a substantially straight line on the beam member, said support elements having machined therein, at portions spaced from the beam member, mutually precisely aligned faces.

An advantage of the above support member is that deviations in straightness of the beam member do not affect the straightness of the slider rod.

In preferred embodiments the slider rod and the beam member are of the same material. This avoids any deterioration in print quality brought about by differential thermal expansion. The material is preferably steel, which is relatively inexpensive.

Preferably the support elements are made of a different material from the beam member. Because a relatively small amount of material is needed for the support elements a more expensive material can be used. Also a material chosen for its suitability for being machined can be selected. In preferred embodiments, the support elements are made of brass.

BRIEF DESCRIPTION OF THE DRAWINGS

A preferred embodiment of the present invention will now be described, by way of example only, with reference to the accompanying drawings, of which.

DETAILED DESCRIPTION OF THE INVENTION

Figure 1:
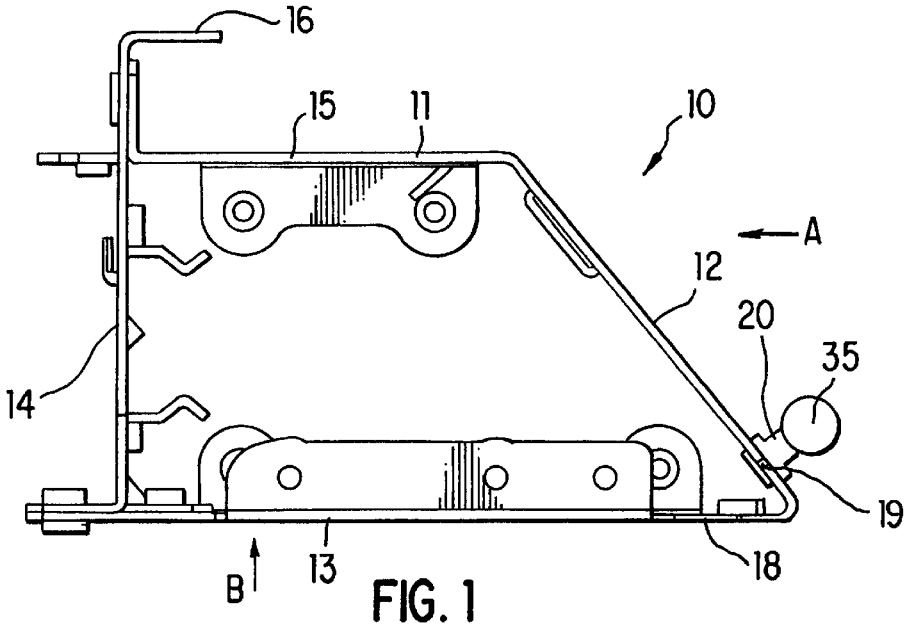
FIG. 1 is an end view of a printer carriage support in accordance with the present invention.
Figure 2:
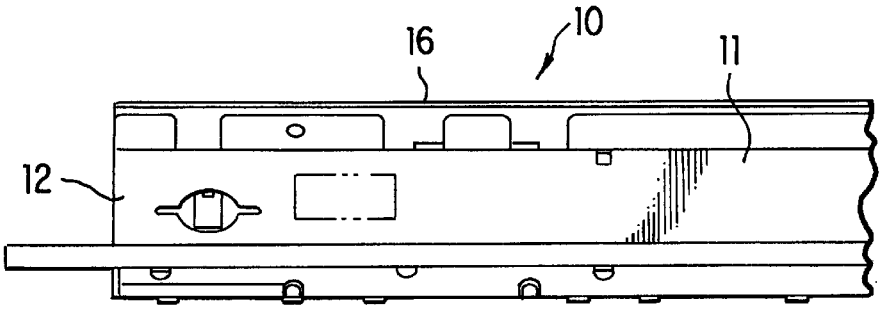
FIG. 2 is a front view of the support of FIG. 1 in the direction of the arrow A.
Figure 3:
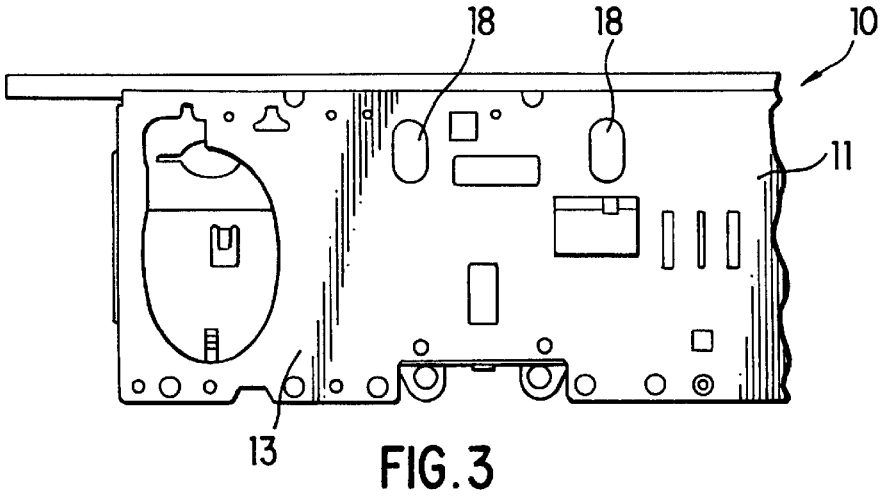
FIG. 3 is a bottom view of the support of FIG. 1 in the direction of the arrow B.

Referring to the drawings, FIGS. 1 to 3 show a printer carriage support 10 comprising a sheet metal beam 11 comprising front, bottom, rear and top walls 12–15. Rear wall 14 is extended at the top to define a horizontal flange 16. Bottom wall 13 has a plurality of spaced openings 18 therein adjacent to, but slightly spaced from its junction with the front wall 12. Front wall 12 has a plurality of openings 19 therein in a substantially straight line adjacent to but slightly spaced from its junction with the bottom wall. The positions of openings 19 are aligned with the openings 18 in the bottom wall.

Figure 4:
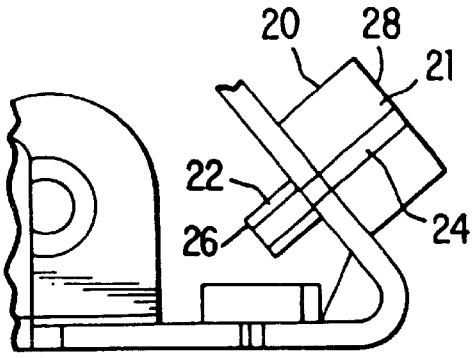
FIGS. 4 to 6 are views of part of the support of FIG. 1 at successive stages of the attachment of a support element to the front of the support.
Figure 5:
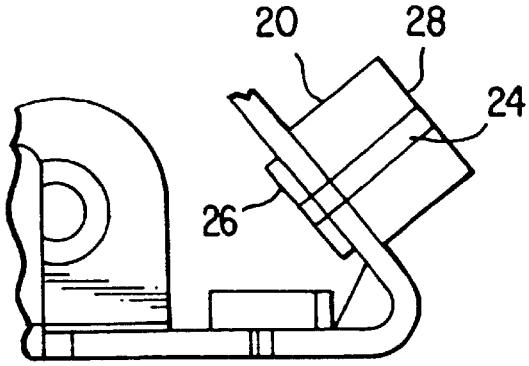
Figure 6:
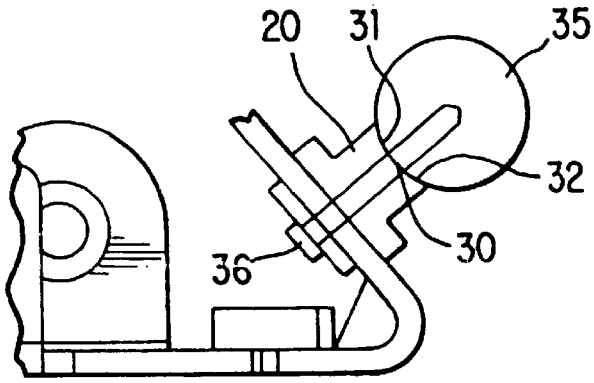

There will now be described a method for fixing a standoff or support element 20 to the front wall in an opening 19. In its initial configuration, shown in FIG. 4, element 20 comprises a generally cylindrical head portion 21 with a narrower shaft portion 22 at one end. Both portions 21, 22 have a central bore 24 extending therethrough.

Shaft portion 21 is inserted from the outside of the beam into opening 19 and the end thereof is then deformed by a clenching operation in the manner of a rivet to firmly fix it to the beam wall 12. To achieve this, the jaws of a suitable tool (not shown) are applied to the end surfaces 26, 28 of the element 20, with one clenching jaw being inserted through the respective opening 18 to gain access to surface 26. Any minor scratching or other damage to surface 28 at this stage is immaterial.

Respective elements 20 are fixed in each of the openings 19, typically ten openings along the length of the beam 11. They extend in a substantially straight line, although there may be minor misalignments due to imperfections in the straightness of the beam 11. In a suitably adapted riveting machine all ten riveting operations are effected simultaneously.

Figure 7:
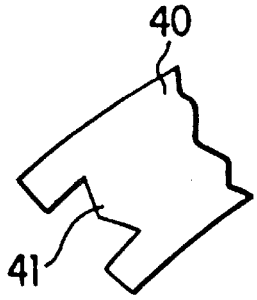
FIG. 7 is an axial section of a cutting tool used to machine the support element as shown in FIG. 6.

There will now be described a method for machining precisely aligned grooves 30 in the elements 20. The beam 11 is held in a chuck of a CNC milling machine with the end surface 28 of cylindrical portions being arranged along the line of movement of the cutting tool 40 shown in FIG. 7. The cutting tool 40 comprises a pointed cutting head 41 which moves precisely along a straight line to cut a V-shaped groove 30 in each element 20 in a single traverse of the beam 11. Each groove comprises opposed inclining faces 31, 32.

Even if an element 20 is slightly misaligned with the other elements 20, its groove 30 is not.

A steel rod 35 is then attached to the elements 20 by means of screws 36 passing through bores 24 and into the rod 35. The rod 35 has a circular cross-section which is accurately positioned by having a line contact with each face of the groove 30.

When the support 10 is installed in a printer, a printer carriage is mounted on the beam 11 with two bushings sliding on the rod 35 and one bushing sliding along flange 16.

An advantage of the above-described arrangement for supporting slider rod 35 is that the beam 11 can be manufactured relatively easily and cheaply. The accuracy of the grooves 30 is provided by the use of an extremely precise CNC milling machine which produces the grooves in a single quick operation, so that successive supports 10 can be processed in rapid succession. The grooves 30 permit accurate location of the slider rod 35 which is advantageous because the printhead (not shown) is arranged to be located relatively close to the rod. The precision of the other slider surface of flange 16 is not so important because it is relatively remote from the printhead so that any movements caused by imperfections in flange 16 and tending to cause the printer carriage to rotate about rod 35 have a minimal effect. For example, even for beams 11 with a length of 1100 mm, a tolerance of 0.1 mm for the straightness of rod 35 has been obtained. This is to be contrasted with the tolerance of 0.28 mm required at flange 16.

The advantage of using a riveting method for attaching standoff elements 20 to the beam 11 is that it is a quick and cheap method of attachment. Riveting also allows different materials to be employed for the beam 11 and elements 20. Typically steel is used as the material for beam 11, since it is relatively inexpensive and brass for the standoff elements 20, brass being easily machinable, especially when of cylindrical cross-section. The use of steel for both beam 11 and rod 35 avoids any adverse effects caused by differential thermal movements.

Although the standoff elements 20 allow a high degree of accuracy, they are relatively cheap to produce. Since typically only ten discrete portions have to be machined, the machining operation takes approximately a fifth of the time of machining a continuous groove along the entire length of the beam as in some prior art arrangements. The use of discrete portions also facilitates straightness.

Various modifications may be made to the above-described arrangement. For example, various methods may be used to attach the standoff elements 20 to the beam 11 such as soldering or welding. The elements 20 can be of other machinable metals, such as aluminium or copper, or of plastics material, in which case the shaft portion 22 may be thermally deformed in suitable instances. Metal elements 20 are preferred, however, since they are more stable. Alternatively elements 20 may be attached to beam 11 by adhesive.

The cross-sectional shape of elements 20 may be polygonal, e.g. square, hexagonal or octagonal, instead of cylindrical since it is only the alignment of grooves 30 which is important. The grooves do not need to define V-shapes; for example the bottom of the grooves may be flat or curved provided that the walls are inclined where they are engaged by the rod 21.

In another modification, the ends of support elements 20 are each provided with a single flat face generally parallel to the plane of the front wall 12. The flat faces are precisely aligned in a machining operation with an appropriate tool. A slider rod 35 is then attached by screws 36 which serve to maintain the slider rod straight in both directions perpendicular to its axis.

The rear bushing may slide on the top surface of flange 16 instead of, or in addition to, along its bottom surface. Instead of flange 16, the other slider may also be constituted by a slider rod, e.g. a rod 35 aligned in a similar manner by standoff elements 20. The number of bushings which the carriage has on each slider mounting may be one or two, the preferred total number of bushings being three.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method of manufacturing a hardcopy apparatus support comprising the steps of:

fixing a plurality of support elements at spaced intervals in a substantially straight line on a beam member;

subsequently machining substantially precisely aligned faces in portions of the support elements spaced from the beam member; and subsequently mounting and securing a slider rod to said faces.

2. A method according to claim 1, further comprising:

deforming said support elements to fix said plurality of support elements to said beam member.

3. A method according to claim 1, further comprising:

machining said faces in a single traverse along the beam member by a cutting head of a cuffing machine.

4. A method according to claim 1, further comprising:

machining said faces to include a plurality of opposed inclining walls substantially grooved shape.

5. A support member for a hardcopy apparatus carriage comprising:

a beam member;

at least one slider rod;

means for securing the rod to the beam member, wherein said securing means comprises a plurality of support elements at substantially spaced intervals in a substantially straight line on the beam member;

wherein said support elements have machined therein, mutually substantially precisely aligned faces at portions spaced from the beam member; and wherein the beam member has a first row and a second row of mutually-adjacent apertures, and wherein the support elements are fixed in said apertures in one of the first and second rows.

6. A support member according to claim 5, wherein the beam member has front, bottom, rear and top walls and the first and second apertures are located in the front and bottom walls, the support elements being fixed in the first apertures in the front wall.

7. A support member according to claim 5, wherein the support elements are riveted to the beam member.

8. A support member according to claim 5, wherein each support element comprises a cylindrical head portion and a narrower shaft portion.

9. A support member according to claim 8, wherein said faces are provided in said head portions.

10. A support member according to claim 5, wherein the support elements are riveted to the beam member, wherein each said support element comprises a cylindrical head portion and a narrower shaft portion, and wherein said shaft portion is riveted to said beam member.

11. A support member according to claim 5, wherein each support element has two faces machined therein, and wherein the faces form opposed inclining walls having a substantially grooved shape.

12. A support member according to claim 5, wherein the support elements have a central through bore through which said slider rod is screwed to the beam member.

13. A support member according to claim 5, wherein the slider rod and the beam member are of the same material.

14. A support member according to claim 13, wherein the slider rod and the beam member are both made of steel.

15. A support member according to claim 5, wherein the support elements are of a different material from that of the beam member.

16. A support member according to claim 5, wherein the support elements are made of brass.

17. A support member for a hardcopy apparatus carriage comprising:

a beam member having a first row and a second row of mutually-apertures, adjacent apertures, said beam member further having front, bottom, rear and top walls, wherein the first and second apertures are located in the front and bottom walls;

at least one slider rod;

means for securing the rod to the beam member, wherein said securing means comprises a plurality of support elements at substantially spaced intervals in a substantially straight line on the beam member, wherein said support elements have machined therein, mutually substantially precisely aligned faces at portions spaced from the beam member, and wherein said support elements are fixed in the first apertures in the front wall.

18. A support member according to claim 17, wherein said at least one slider rod includes a plurality of grooves, and wherein said securing means includes mating said grooves of said at least one slider rod with said faces of said support elements.

19. A method of manufacturing a hardcopy apparatus support comprising the steps of:

fixing a plurality of support elements at spaced intervals in a substantially straight line one a beam member, wherein the beam member has a first row and a second row of mutually adjacent apertures, and wherein the support elements are located in said apertures in the first row, the method further comprising fixing said plurality of support elements to said beam member by means of a tool having two jaws, and passing on of said jaws through said apertures in the second row;

machining substantially precisely aligned faces in portions of the support elements spaced from the beam member; and mounting and securing a slider rod to said faces.

20. A support member for a hardcopy apparatus carriage comprising:

a beam member;

at least one slider rod;

means for securing the rod to the beam member, wherein said securing means comprises a plurality of support elements at spaced intervals in a substantially straight line on the beam member, each of said support elements comprising a cylindrical head portion and a narrower shaft portion; and wherein said support elements have machined therein, mutually substantially precisely aligned faces at portions spaced from the beam member.

21. A support member for a hardcopy apparatus comprising:

a beam member;

at least one slider rod;

means for securing the rod to the beam member, wherein said securing means comprises a plurality of support elements at spaced intervals in a substantially straight line on the beam member; each of said support elements having a central through bore through which said slider rod is screwed to the beam member; and wherein said support elements have machined thereon, mutually substantially precisely aligned faces at portions spaced from the beam member.

* * * * *

UNITED STATES PATENT AND TRADEMARK OFFICE

CERTIFICATE OF CORRECTION

PATENT NO. : 6,648,529 B2
DATED : November 18, 2003
INVENTOR(S) : Bartolome et al.

It is certified that error appears in the above-identified patent and that said Letters Patent is hereby corrected as shown below:

Column 2,
Line 43, replace number “21” with number -- 22 -- between “portion” and “is”.

Column 4,
Line 36, replace “cuffing” with -- cutting --.
Line 39, insert -- having a -- between “walls” and “substantially”.

Column 5,
Line 25, delete “apertures,” between “mutually-” and “adjacent”

Signed and Sealed this

Twenty-seventh Day of April, 2004

JON W. DUDAS
*Acting Director of the United States Patent and Trademark Office*